United States Patent [19]

Holes et al.

[11] 4,172,332

[45] Oct. 30, 1979

[54] PHOTOGRAPH ALBUM

[75] Inventors: William W. Holes; Roger A. Wenstrom, both of St. Cloud; John P. Ratzloff, Clear Lake, all of Minn.

[73] Assignee: The Holes-Webway Co., St. Cloud, Minn.

[21] Appl. No.: 838,840

[22] Filed: Oct. 3, 1977

[51] Int. Cl.[2] ..... G09F 1/12

[52] U.S. Cl. ..... 40/159; 40/537; 281/31; 402/3

[58] Field of Search ..... 40/159, 156, 157, 158 R, 40/152, 405, 537; 402/3, 78; 281/31

56] References Cited

U.S. PATENT DOCUMENTS

| | | | |
|---|---|---|---|
| 1,696,629 | 12/1928 | Fenno | 281/31 |
| 1,845,445 | 2/1932 | Schlichting | 402/3 |
| 2,394,980 | 2/1946 | Byck | 40/159 |
| 2,544,566 | 3/1951 | Rose | 402/3 |
| 2,852,275 | 9/1958 | Brook | 40/159 X |
| 3,485,564 | 12/1969 | Holes et al. | 402/3 |
| 3,813,799 | 6/1974 | Caravello | 40/152 |
| 4,114,300 | 9/1978 | Holson | 40/152 |

*Primary Examiner*—John F. Pitrelli

*Attorney, Agent, or Firm*—Williamson, Bains, Moore & Hansen

[57] ABSTRACT

A photograph album includes front and rear covers and a plurality of album pages releasably bound together. The front cover is constructed to present a picture frame comprising an outer frame assembly having a mat sheet provided with a plurality of various sized openings therein. The frame assembly frames a plurality of photographs and each opening in the mat individually frames each photograph.

1 Claim, 2 Drawing Figures

PHOTOGRAPH ALBUM

SUMMARY OF THE INVENTION

This invention relates to photograph albums and more particularly to a photograph album having a picture frame as the front cover thereof.

It is an object of this invention to provide a novel front cover, of simple and inexpensive construction, for a photograph album in which the front cover is arranged and constructed to present a picture frame for accommodating one or more photographs or pictures.

More specifically, it is an object of this invention to provide a photograph album front cover in the form of a picture frame wherein the front cover includes a frame assembly and a mat sheet having a plurality of various shaped openings therein to esthetically frame one or more photographs.

These and other objects and advantages of this invention will more fully appear from the foregoing description made in connection with the accompanying drawings, wherein like reference characters refer to the same or similar parts throughout the several views.

FIGURES OF THE DRAWINGS

DESCRIPTION OF THE PREFERRED EMBODIMENT

Figures 1, 2:
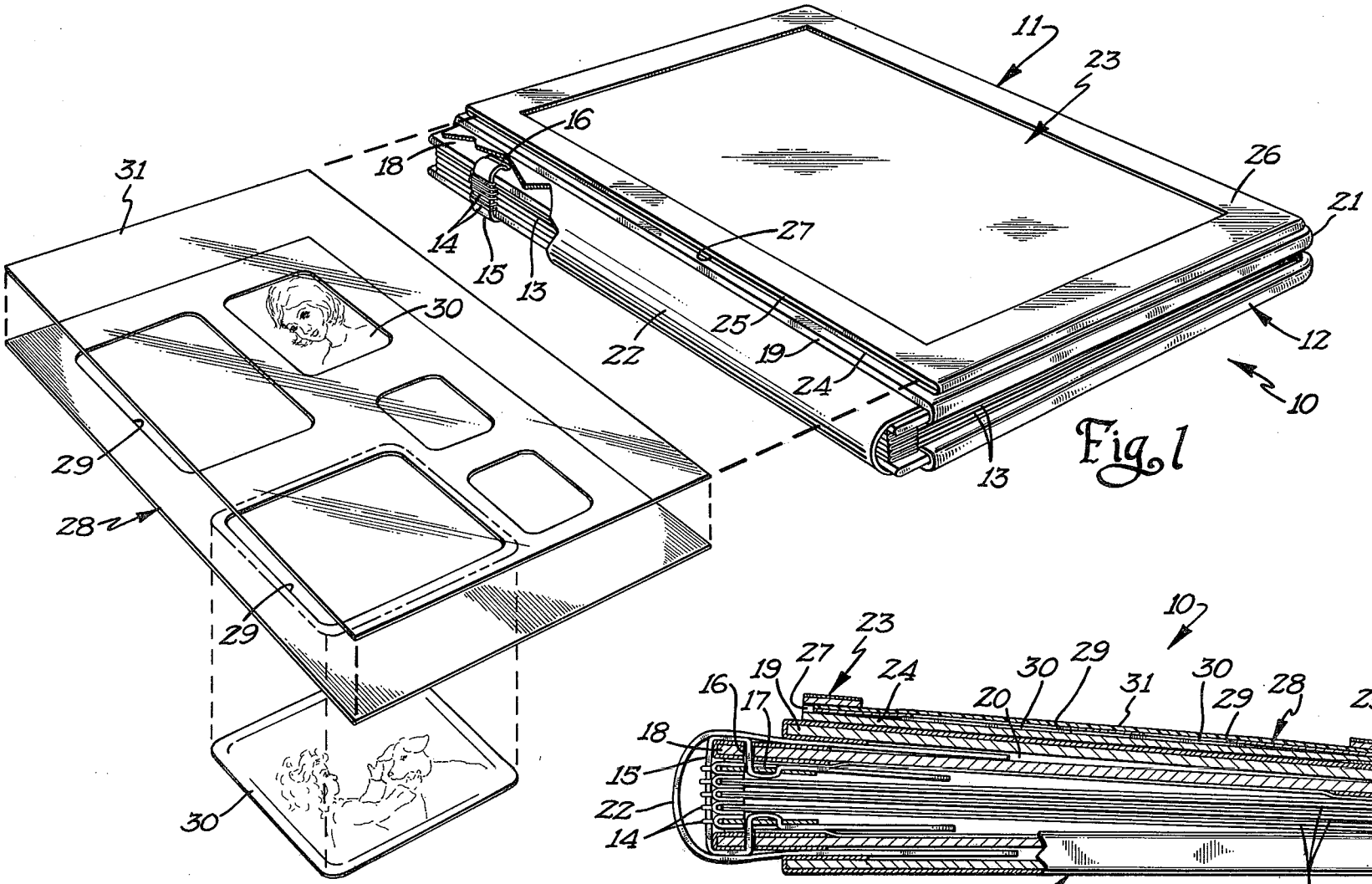
FIG. 1 is a perspective view of the novel photograph album with certain parts thereof exploded to illustrate detailed construction of components thereof and other parts thereof broken away for clarity.
FIG. 2 is a cross-sectional view of the album illustrating details of construction of a front cover thereof.

Referring now to the drawings and more particularly to FIG. 1, it will be seen that one embodiment of the novel photograph album designated generally by the reference numeral 10, is thereshown. The album 10 includes a front cover 11, a rear cover 12 and a plurality of album pages 13. The pages 11 are each provided with a pair of longitudinally spaced-apart U-shaped hinge elements 14 which are secured to one longitudinal edge thereof by an adhesive strip. The U-shaped hinge elements 14 project outwardly from the longitudinal edge of each page 13 and a pair of elongate straps 15 extend through the hinge elements and through slots in the front and rear covers to releasably bind the pages to the front and rear covers. In the embodiment shown, the straps 15 extend through slots 16 in the front and rear covers and are secured to anchor members 17. Each anchor member 17 is positioned between one of the covers and the adjacent page. The particular construction of the hinge elements and anchor members are disclosed in my U.S. Pat. No. 3,485,564, and that disclosure is enclosed herewith by reference thereto.

The front cover 11 is arranged and constructed to present a picture frame which enhances the overall esthetic appearance of the album. The front cover includes a generally rectangular shaped base sheet 18 formed of rigid paper board to which is secured a generally rectangular intermediate sheet which is also formed of rigid paper board material. It will be noted that the length dimensions of the intermediate sheet corresponds to the length dimensions of the base sheet, but the base sheet is slightly wider than the intermediate sheet and presents an uncovered lip portion 18*a*. The base sheet and intermediate sheet are secured together along three sides by cover material 21 which is formed of a decorative plastic material. The cover material 21 also respectively covers the remaining edge of each of the base and intermediate sheets, but does not bind them together so that one longitudinal edge of the base sheet is not secured against the adjacent edge portion of the intermediate sheet. Thus, a pocket 20 is formed which accommodates a flexible hinge covering member 22. The hinge covering member also extends into a corresponding pocket formed in the rear cover.

The front cover also includes a frame assembly 23 which is comprised of a generally rectangular shaped backing sheet 24 formed of flexible paper board material. A generally rectangular shaped frame member 25 is positioned upon the backing sheet 24 and a cover material 26 similar to the cover material 21 extends over and covers the frame member 25 and the marginal portions of the backing sheet 24 along three edges thereof. Again, it will be noted that the cover 26 does not extend over and bind one longitudinal edge of the backing sheet to one longitudinal edge of the frame member 25 whereby an access opening 27 is formed along one longitudinal edge of the frame assembly 23 throughout the length of the latter. The frame assembly 23 is secured to the intermediate sheet 19 by suitable glue or cement. The frame assembly 23 actually presents a picture frame on the upper surface of the front cover 11.

The frame assembly also includes a generally rectangular shaped mat 28 formed of paper and having a plurality of various shaped openings 29 therein. The mat 28 has a length dimension to permit it to be inserted into the access opening 27 of the frame assembly 23 and has a width dimension to underlie the edges of the frame assembly defined by the frame member 25. Photographs are positioned upon the backing member and behind the mat 28 so that each photograph is exposed by one of the openings 29. A transparent sheet 31 having a length dimension to permit it to be inserted through the access opening 27 is positioned upon the mat 28. The transparent sheet 31 has a width corresponding to the width dimension of the mat and therefore underlies the inner edges defined by the frame member 25.

It will be seen that the photographs framed by the frame assembly 23 may be readily removed and replace the access opening 27. It is pointed out that the rear cover is constructed in the same manner as the front cover but has no frame assembly.

It will be noted that the front album covering while presenting an extremely attractive appearance is of simple and inexpensive construction. It will also be noted that by changing photographs framed by the frame assembly of the front cover, the front cover may have its appearance easily changed.

Thus, it will be seen that I have provided a photograph album which is provided with an uniquely constructed but attractive front cover which differs from any heretofore known or comparable album.

What is claimed is:

1. A photograph album comprising:

a front cover and a rear cover, a plurality of album pages having a pair of spaced apart U-shaped hinges affixed to one longitudinal edge thereof and projecting outwardly therefrom, a pair of flexible strap members each extending through one of the U-shaped hinges on each page and each strap having one end releasably secured to the front cover and having the other end thereof releasably secured to the rear cover, said front cover including a rigid base sheet, an intermediate sheet positioned upon the base sheet and being secured to the latter, one longitudinal edge portion of said intermediate sheet remaining detached from the base sheet and defining therebetween a pocket extending substantially throughout the length of the front cover, a flexible cover material covering the marginal portions of the base and intermediate sheets, a rectangular frame assembly corresponding in size to said front cover and being secured to the latter, said frame assembly including a backing sheet and a rectangular frame member positioned upon and engaging the backing sheet, said frame member and backing sheet being formed of paper board material, a cover material covering the frame member and the marginal portions of the backing sheet along three sides of the latter to secure the marginal edge of the frame and backing member together along three adjacent edges, one longitudinal edge of said backing remaining detached from the corresponding longitudinal edge of the frame member to define an access opening throughout the length of said frame assembly located closely adjacent the opening for said pocket, a mat sheet formed of paper material and having a plurality of various shaped openings therein being positioned between the frame member and backing sheet, said mat sheet being readily removable from between the backing member and frame member along the unsecured longitudinal edges of the frame member and backing sheet, and a transparent sheet positioned between the mat sheet and the frame member.

* * * * *